US007963007B2

(12) United States Patent
Anzini et al.

(10) Patent No.: US 7,963,007 B2
(45) Date of Patent: Jun. 21, 2011

(54) HIGH BURST ZIPPER ASSEMBLY FOR LARGE RECLOSABLE PACKAGES

(75) Inventors: David J. Anzini, Middletown, NY (US); Rusty Koenigkramer, Nanuet, NY (US); Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 1043 days.

(21) Appl. No.: 11/728,477

(22) Filed: Mar. 26, 2007

(65) Prior Publication Data

US 2008/0050052 A1 Feb. 28, 2008

Related U.S. Application Data

(60) Provisional application No. 60/839,447, filed on Aug. 23, 2006.

(51) Int. Cl.
*A44B 19/16* (2006.01)

(52) U.S. Cl. ..... 24/400; 24/30.5 R; 383/210.1; 383/61.2

(58) Field of Classification Search ..... 383/5, 210–211, 383/61.2, 61.3, 63, 64, 203; 24/30.5 R, 399, 24/400, 585.12, DIG. 50, DIG. 11, 389, 304; 53/412, 133.4, 139.2; 493/213
See application file for complete search history.

(56) References Cited

U.S. PATENT DOCUMENTS 4,534,752 A 8/1985 Ferrell et al.
4,620,320 A 10/1986 Sullivan
4,637,063 A 1/1987 Sullivan
4,691,373 A 9/1987 Ausnit
4,731,911 A 3/1988 Gould
4,835,835 A 6/1989 Gould
4,912,616 A * 3/1990 Van Erden ..... 383/65
4,984,949 A 1/1991 Reckziegel
5,185,909 A 2/1993 Inagaki
5,342,873 A 8/1994 Merz et al.
5,425,825 A 6/1995 Rasko et al.
5,509,735 A 4/1996 May
5,513,915 A 5/1996 May
5,709,915 A 1/1998 Tomic et al.
5,749,658 A 5/1998 Kettner
5,827,163 A 10/1998 Kettner
6,131,248 A 10/2000 Tomic
6,138,439 A 10/2000 McMahon et al.
6,183,134 B1 2/2001 Malin
6,317,939 B1 11/2001 Malin
(Continued)

FOREIGN PATENT DOCUMENTS

AU 2007288457 2/2008
(Continued)

*Primary Examiner* — James R Brittain
(74) *Attorney, Agent, or Firm* — Day Pitney LLP

(57) ABSTRACT

The present disclosure relates to a high burst slider zipper which allows for bottom filling of reclosable packages, such as large bags, and further provides increased resistance to damage from the dropping or shock loading of the filled package. This is achieved by providing a peel seal or other frangible or separable connection between the zipper profiles, and by sealing a portion of one of the flanges to itself by a hard seal above the peel seal. This causes the external forces on a bag from bottom filling or shock loading to be directed toward the hard seal and further directed so as to cause a shear force against the peel seal, thereby increasing the resistance of the package to external forces.

9 Claims, 12 Drawing Sheets

U.S. PATENT DOCUMENTS

| | | | | |
|---|---|---|---|---|
| 6,327,754 | B1 | 12/2001 | Belmont et al. | |
| 6,327,837 | B1 | 12/2001 | Van Erden | |
| 6,354,738 | B1 | 3/2002 | Buckman et al. | |
| 6,360,513 | B1 | 3/2002 | Strand et al. | |
| 6,427,421 | B1 | 8/2002 | Belmont et al. | |
| 6,890,982 | B2 | 5/2005 | Borsinger et al. | |
| 6,910,805 | B2 * | 6/2005 | Johnson | 383/61.2 |
| 6,979,482 | B2 | 12/2005 | Hartzell et al. | |
| 6,993,886 | B2 | 2/2006 | Johnson | |
| 7,090,904 | B2 | 8/2006 | Hartzell et al. | |
| 7,132,144 | B2 | 11/2006 | Roberts | |
| 7,219,481 | B2 | 5/2007 | Buchman et al. | |
| 7,249,887 | B2 | 7/2007 | Kinigakis et al. | |
| 7,267,878 | B2 | 9/2007 | Primke et al. | |
| 7,308,783 | B2 | 12/2007 | Shepard et al. | |
| 7,424,796 | B2 | 9/2008 | Shepard et al. | |
| 7,430,844 | B2 | 10/2008 | Buchman et al. | |
| 7,748,200 | B2 | 7/2010 | Buchman | |
| 2002/0100144 | A1 | 8/2002 | Machacek et al. | |
| 2003/0002753 | A1 | 1/2003 | Stolmeier et al. | |
| 2003/0103689 | A1 | 6/2003 | Schneider et al. | |
| 2003/0118253 | A1 | 6/2003 | Machacek | |
| 2005/0025394 | A1 * | 2/2005 | Kinigakis et al. | 383/61.2 |
| 2006/0062495 | A1 * | 3/2006 | Plourde et al. | 383/61.2 |
| 2006/0120630 | A9 | 6/2006 | Ausnit et al. | |
| 2006/0252626 | A1 | 11/2006 | Delisle et al. | |
| 2006/0285778 | A1 | 12/2006 | May et al. | |
| 2007/0065051 | A1 | 3/2007 | Eads et al. | |
| 2008/0050056 | A1 | 2/2008 | Anzini et al. | |
| 2009/0097783 | A1 | 4/2009 | Anzini et al. | |

FOREIGN PATENT DOCUMENTS

| | | | |
|---|---|---|---|
| CA | 2654568 | | 2/2008 |
| CN | 101484363 | | 7/2009 |
| DE | 82 36 160 | U1 | 10/1983 |
| EP | 1 375 370 | A | 1/2004 |
| JP | 1226556 | | 9/1989 |
| WO | 2008024157 | | 2/2008 |
| WO | 2008118574 | | 10/2008 |

* cited by examiner

HIGH BURST ZIPPER ASSEMBLY FOR LARGE RECLOSABLE PACKAGES

This application claims priority under 35 U.S.C. §119(e) from provisional application Ser. No. 60/839,447, filed on Aug. 23, 2006, entitled "High Burst Slider Zipper for Large Bags and Method of Manufacture", the contents of which are hereby incorporated by reference. This application is being filed simultaneously with applications entitled "Method of Producing High Burst Zipper Assemblies for Large Reclosable Packages" and "Hot Melt Adhesive Systems for Zipper Assemblies on Large Bag Constructions of Various Substrates".

BACKGROUND OF THE INVENTION

1. Field of the Invention

The present invention relates to zipper assemblies for reclosable packages which are large bags, particularly zipper assemblies which achieve high burst strengths, and the methods for manufacture thereof. These zipper assemblies may include sliders or may have a press-to-close configuration.

2. Description of the Prior Art

Large packages, bags or pouches, such as those used for pet food, charcoal, cat litter and similar items are typically filled and sealed shut, with no reclosure mechanism. These packages may be formed by form fill and seal (FFS) or by other methods. Prior attempts to incorporate a zipper reclosure mechanism have been unsatisfactory due to the unique requirements of a large bag with a relatively heavy load. In particular, filling from the bottom places all of the load on the reclosure during filling. This load can cause the zipper reclosure to fail and open. Similarly, dropping a filled bag onto a pallet or similar rough handling during transportation, as well as exposing a bag to elevated temperatures during transportation, can cause the zipper reclosure to fail.

The prior art has addressed these deficiencies by folding over the end of the package, particularly a multi-wall package, using an expensive label as tape thereby allowing successful filling and transport. Similarly, the prior art has addressed these deficiencies by using a liner peel seal below the zipper and a solid tear line in the zipper flange to provide a fill and transport system that does not rupture and spill the contents. However, these methods have slow rates of production, as well as increased costs of production, and frequently do not result in a satisfactory product for the consumer.

Some further examples of the prior art which are not entirely satisfactory are found in U.S. Pat. No. 6,979,482 entitled "Multiwall Bag with Zipper and Fin" issued on Dec. 27, 2005 to Hartzell et al. and U.S. Pat. No. 7,090,904 entitled "Enhanced Slider Zipper Multiwall Bag and Associated Methods" issued On Aug. 15, 2006 to Hartzell et al.

Typical prior tamper-evident zipper assemblies are disclosed in U.S. Pat. No. 6,354,738 entitled "Tamper Evident Reclosable Plastic Bag" issued on Mar. 12, 2002 to Buckman et al.; U.S. Pat. No. 4,647,063 entitled "Reclosable Bag with Laminated Liner and Method" issued on Jan. 13, 1987 to Sullivan; and U.S. Pat. No. 5,509,735 entitled "Closure Arrangement Having a Peelable Seal" issued on Apr. 23, 1996 to May.

OBJECTS AND SUMMARY OF THE INVENTION

It is therefore an object of the present invention to provide a zipper assembly for reclosable packages, particularly large bags, formed by form fill and seal or other methods, which provides for high burst strength in bottom filling or top filling configurations, to allow the bags to withstand dropping or shock loading without the zipper reclosure bursting open.

It is therefore a further object of the present invention to provide such a zipper assembly without significant increases in manufacturing and related costs.

It is therefore a still further object of the present invention to provide a method of manufacture for a product achieving the above objects.

These and other objects are attained by providing a zipper assembly for reclosable packages, particularly large bags, wherein the flanges are sealed together with a peel seal or other frangible seal, and one of the flanges is folded so as to be sealed to itself above the peel seal. This causes the external forces on a bag from bottom filling or shock loading (or forces from within the bag, typically created when the bag is dropped on its top or side) to be directed toward the hard seal and redirecting the peel seal from a peel position to a shear position. As the force required to separate a peel seal in a shear position is several times greater than the force required to separate the peel seal in a peelable position, the load-bearing capacity of the package or bag is increased.

These and other objects are similarly obtained by providing a zipper assembly for reclosable package, particularly large bags, wherein one of the flanges is provided in two segments in a T-configuration, with the intersection of the two segments being above the peel seal.

These and other objects are similarly obtained by providing a zipper assembly for a reclosable package, particularly large bags, with a folded flange with a peel seal above the fold and a tear line or other frangible connection at the fold.

The slider zipper is thereby manufactured. In order to subsequently manufacture the reclosable package, the zipper assembly is subjected to a slider zipper process whereby the zipper is provided from a spool. The flanges on this ribbon are then spread open, typically by a vacuum or similar device, and an adhesive which is compatible with the bag substrate is applied to the inside face of the flanges. The zipper with adhesive is placed over a series of packages or bags and sealed thereto via a temporary application of pressure, typically with clamps, over the adhesive coated flanges. End stomps (typically two at a time) are formed on the zipper and sliders are sequentially mounted on the zipper. The portions of the flanges between the successive bags are heat sealed, glued, or ultrasonically bonded to each other. The zipper segment, and hence the completed package or bag, is then cut from the ribbon. For a gusseted package or bag, the gussets are glued or otherwise connected so that the gussets are under the zipper flange.

Adhesive sealing methods, particularly hot melt, cross-linkable adhesive (such as hot melt cross-linkable polyurethane reactive adhesive) sealing methods, may be preferred over heat sealing methods in order to reduce the electrical power requirements for the production site.

DESCRIPTION OF THE DRAWINGS

Further objects and advantages of the invention will become apparent from the following description and from the accompanying drawings, wherein.

DETAILED DESCRIPTION OF THE PREFERRED EMBODIMENTS

Figure 1:
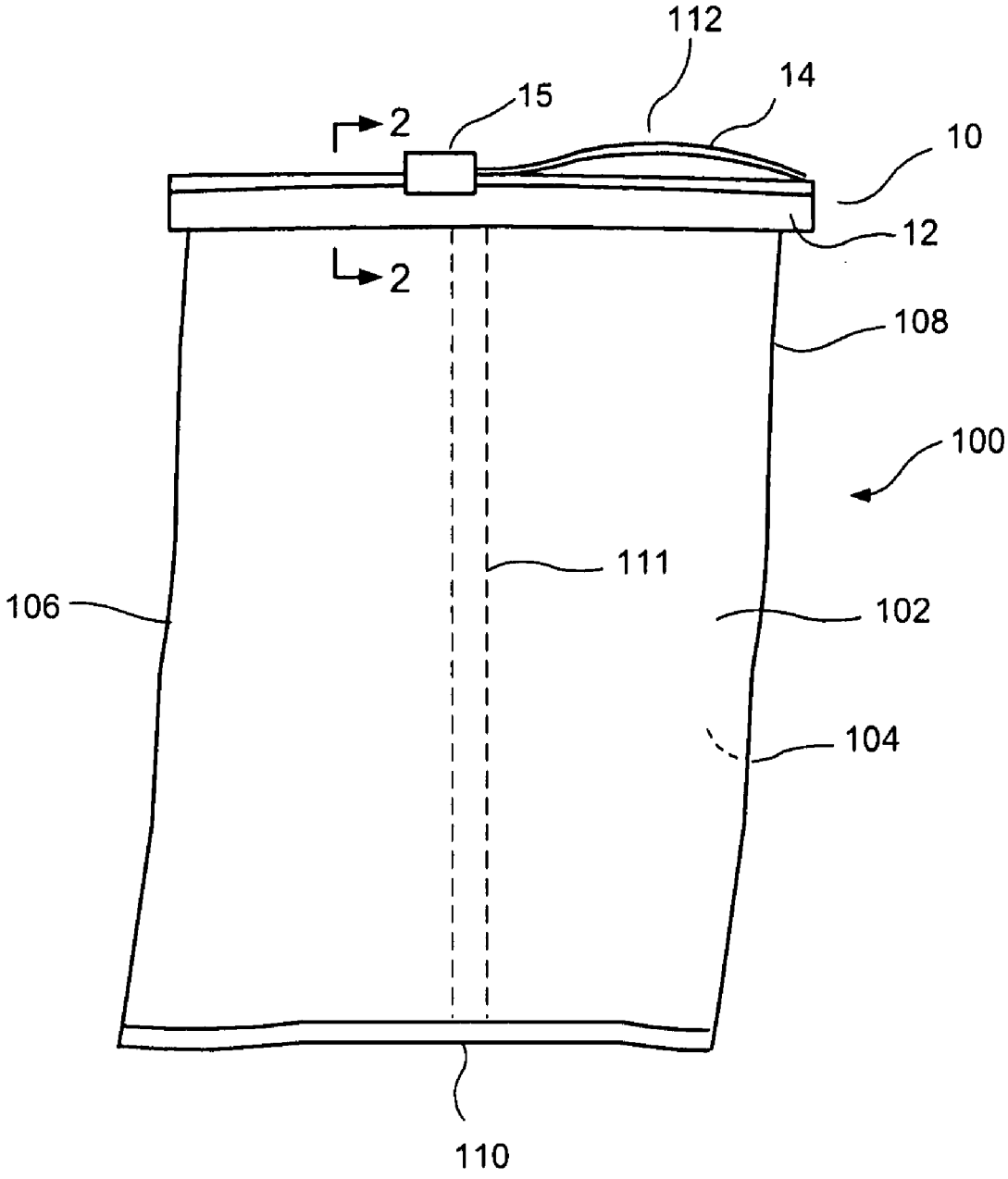
FIG. 1 is a plan view, partially in phantom, of a typical reclosable package incorporating the zipper assembly of the present invention.

Referring now to the drawings in detail wherein like numerals indicate like elements throughout the several views, one sees that FIG. 1 is a perspective view of a typical reclosable package 100, such as a large bag, which incorporates the zipper assembly 10 of the present invention. Reclosable package 100 may be formed by form fill and seal or by other methods. Reclosable package 100 includes a front wall 102 and a rear wall 104. Front and rear walls 102, 104 may be separate polymeric or multi-sheet panels sealed together at edges 106, 108. Alternatively, front and rear walls 102, 104 may be provided as a single tube with or without a lap seal in the longitudinal direction. Front and rear walls 102, 104 may be formed from virtually any substrate in the packaging art—laminate films, plain polyethylene or polypropylene films, multi-wall paper, and polypropylene woven layer bags or any combination or hybrid thereof. Additionally, gussets (not shown) may be provided between front and rear walls 102, 104 at edges 106, 108, or similarly at bottom 110.

Bottom 110 may be sealed shut, or folded over and then glued. Reclosable package 100 is typically bottom filled, so that the seal or glued fold may be formed after filling. However, other methods of filling, such as top filling before the complete application of zipper assembly 10, are equally applicable to the present invention and are disclosed herein.

A longitudinal seal or seam 111, which can be a lap or fin seal or seam, may optionally be formed in a central longitudinal location on rear wall 104 and is shown in phantom on FIG. 1.

Mouth 112 is formed at the top of the reclosable package 100 of FIG. 1, and is reclosably sealed by zipper assembly 10.

Figure 2:
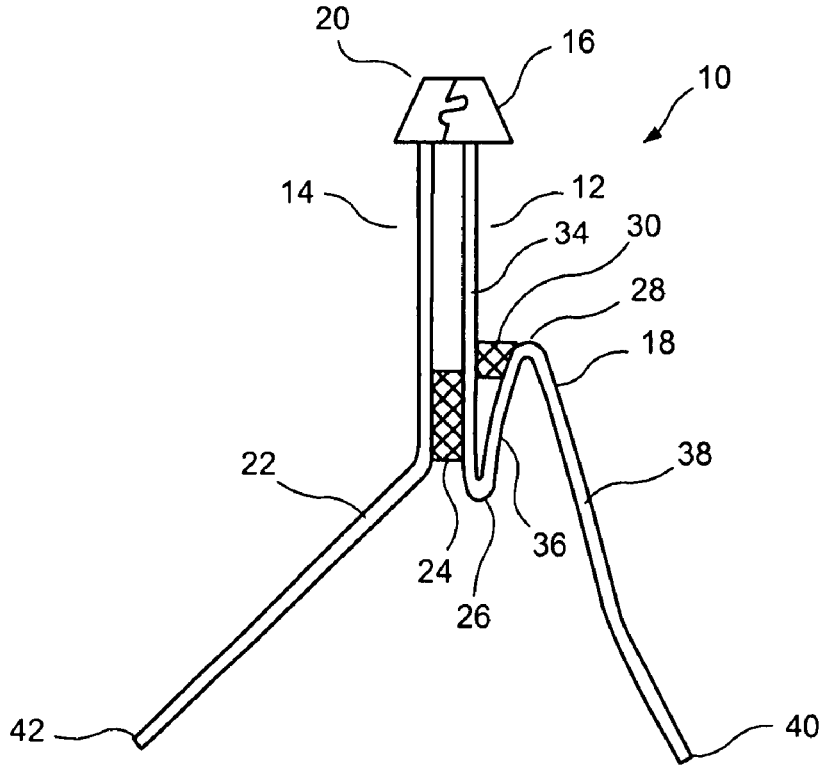
FIG. 2 is a cross-sectional view along the upper portion of plane 2-2 of FIG. 1, showing the cross section of the zipper assembly of the present invention.

As shown in FIGS. 1 and 2, zipper assembly 10 is formed from polymeric materials and includes first profile 12, second profile 14 and optional slider 15 (see FIG. 1). First profile 12 includes first interlocking element 16 and first flange 18. Similarly, second profile 14 includes second interlocking element 20 and second flange 22. Optional slider 15 is mounted on first and second profiles 12, 14 and operates in a conventional manner by interlocking first and second interlocking elements 16, 20 of respective first and second profiles 12, 14 when moved in a closing direction and separating first and second interlocking elements 16, 20 of respective first and second profiles 12, 14 when moved in an opening direction.

Peel seal 24 is formed between central locations of first and second flanges 18, 22. Peel seal 24 may be replaced by other frangible (and therefore tamper-evident) seals, or even a rip-cord (either supplementing or substituting for the peel seal 24). Peel seal 24 is more resistant to shear forces than to peeling forces. Peel seal 24, or any substitutes therefor, particularly when loaded in a shear configuration, is typically sufficiently strong to support the loads required by bottom filling. Peel seal 24 is typically pre-activated, but may be activated at the time of package or bag conversion. Additionally, first flange 18 in FIG. 2 includes upward fold 26 immediately or proximately below peel seal 24. First flange 18 continues upward from upward fold 26 to downward fold 28, wherein hard seal 30 is formed between a portion of first flange 18 above peel seal 24. This configuration can be considered to divide first flange 18 into three portions—first portion 34 which extends from first interlocking element 20 to upward fold 26, second portion 36 which extends from upward fold 26 to downward fold 28, and third portion 38 extends from downward fold 28 to first distal end 40 thereby providing an area for sealing, gluing, or otherwise securing to front wall 102 of package 100. Likewise, second flange 22 extends from second interlocking element 20, past peel seal 24, to second distal end 42 thereby providing an area for sealing, gluing, or otherwise securing to rear wall 104 of package 100. As shown in FIGS. 1, 4, 5 and 6, first and second flanges 18, 22 are typically sealed, glued or otherwise secured to the upper exterior surfaces of front and rear walls 102, 104. However, some embodiments may seal, glue or otherwise secure first and second flanges 18, 22 to upper interior surfaces of respective front and rear walls 102, 104.

Figure 3:
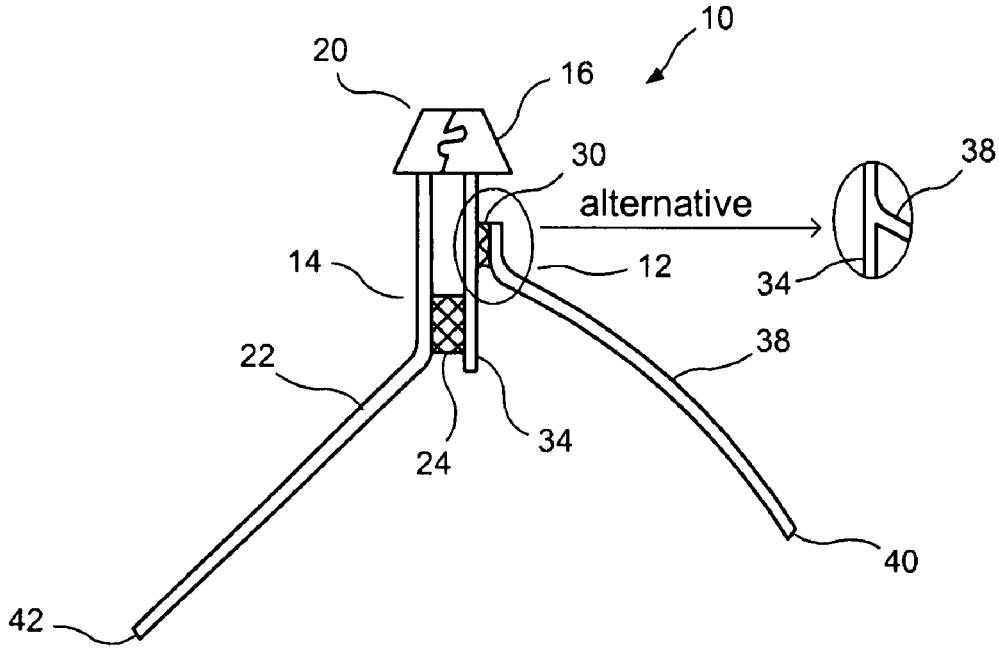
FIG. 3 is a cross-sectional view along the upper portion of plane 2-2 of FIG. 1, showing the cross section of an alternative embodiment of the zipper assembly of the present invention. Additionally, an alternative area of detail is shown with a variation of the alternative embodiment.
Figure 4:
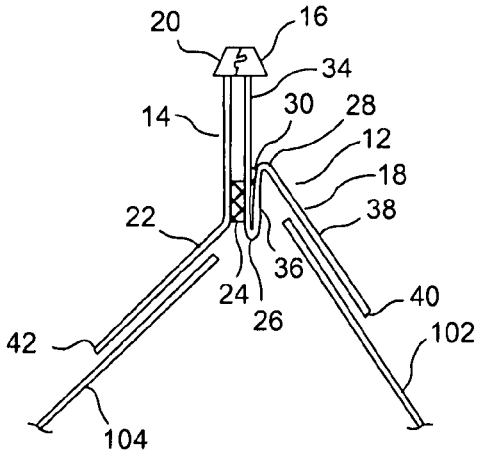
FIG. 4 is a cross-sectional view along the upper portion of plane 2-2 of FIG. 1, showing a cross section of a portion of the package or bag in an unstressed configuration.

In the alternative embodiment of FIG. 3, second portion 36 of first flange 18 is omitted, so that first and third portions 34, 38 are separate sheets or segments of web. Third portion 38 is joined to a central location of first portion 34 by hard seal 30. Alternatively, hard seal 30 can be omitted if first and third portions 34, 38 are formed integrally and simultaneously by extrusion, as shown in the alternative area of detail of FIG. 3.

Figure 5:
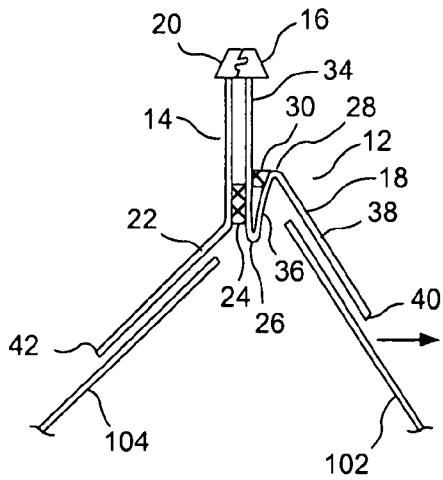
FIG. 5 is a cross-sectional view along the upper portion of plane 2-2 of FIG. 1, showing a cross section of a portion of the package or bag when an internal load (i.e., a force from within the package or bag) is applied thereto.
Figure 6:
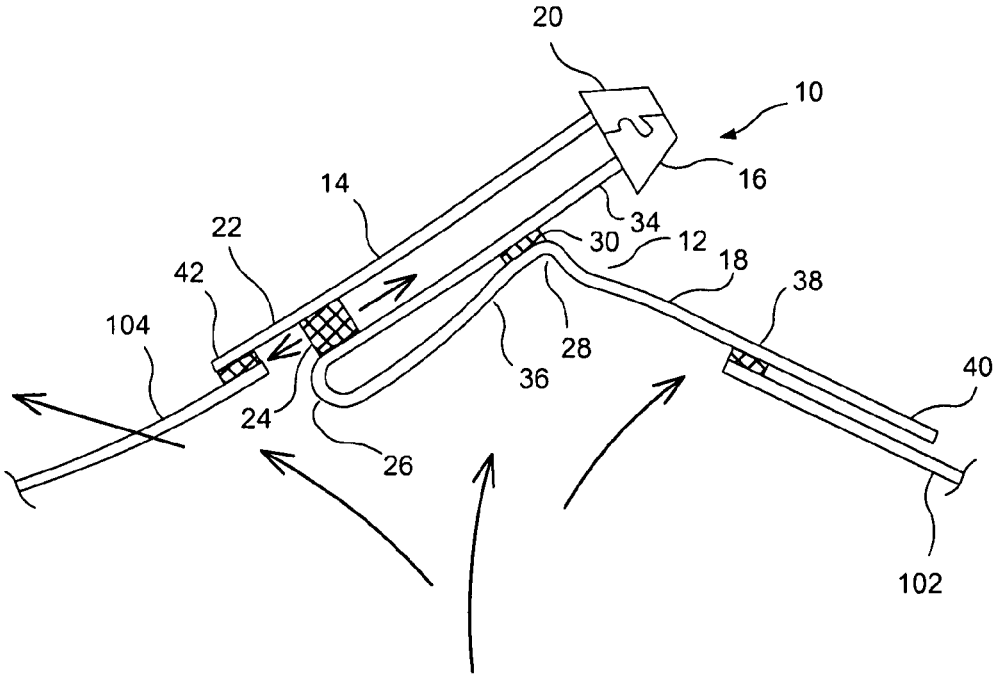
FIG. 6 is a cross-sectional view of the upper portion of plane 2-2 of FIG. 1, showing a cross section of a portion of the package or bag and further showing the resultant forces on the zipper assembly when an internal load is applied to the package or bag.

In the configuration of either embodiment, as shown in FIGS. 5 and 6, the external forces on package 100 from bottom filling or shock loading (or forces from within the bag) are directed toward hard seal 30 (which is above the peel seal 24) and redirected so as to cause a shear force on peel seal 24. As a peel seal is much more resistant to a shear force than a conventional peeling force, the resistance of package 100 to external or internal forces is greatly increased.

Figure 7:
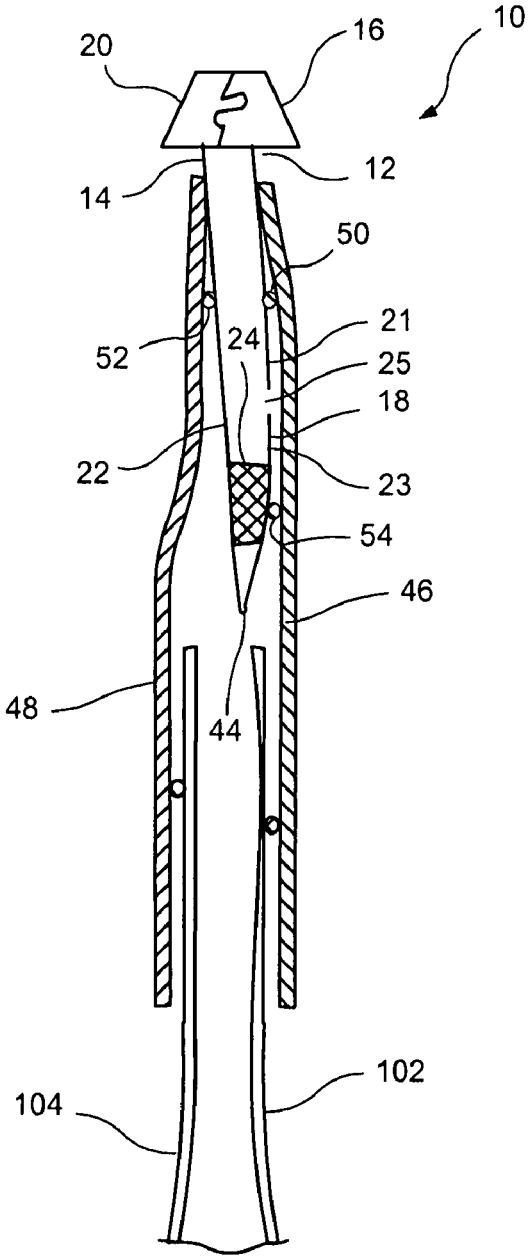
FIG. 7 is a cross-sectional view of a first alternative embodiment of the zipper.
Figure 8:
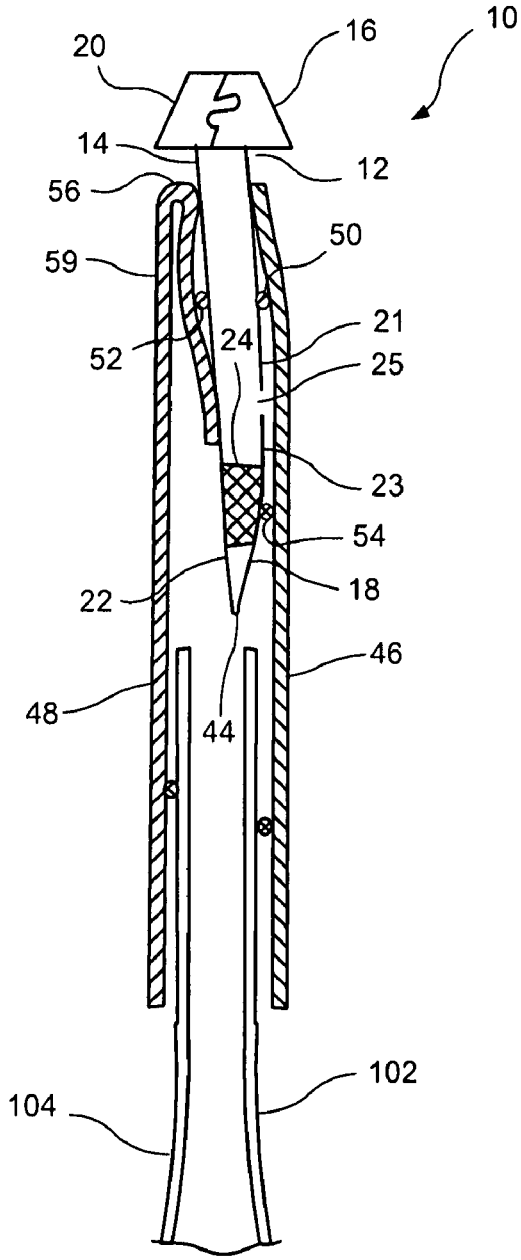
FIG. 8 is a cross-sectional view of a second alternative embodiment of the zipper.

FIGS. 7 and 8 disclose embodiments, wherein first flange 18 is relatively short, extending from profile 16 and terminating upwardly adjacent to gap 25. First flange 18 is sealed or otherwise joined to extension segment 46 at point 50. Second flange 22 includes proximal segment 21 which extends from profile 20. Second flange 22 further includes distal segment 23 which is joined to proximal segment 21 at fold 44 wherein a line of weakness, such as a perforated or scored line, is provided in order to provide additional tamper evidence after opening. Distal segment 23 extends upwardly from fold 44 and terminates downwardly adjacent to gap 25. Second flange 22 is sealed or otherwise joined to extension segment 48 at point 52 and distal segment 23 is sealed or otherwise joined to first extension segment at point 54 and adjacent to peel seal 24. The connections at points 50, 52, 54 are typically formed by heat sealing. Peel seal 24 is further formed between faces (or facing portions) of proximal segment 21 and distal segment 23.

Extension segments 46, 48 are typically formed with nominal 6 mil film, but those skilled in the art will recognize a range of equivalents after review of this disclosure. Extension segments 46, 48 are joined, typically by adhesive, to front and rear walls 102, 104, respectively. The embodiment of FIG. 7 differs from that of FIG. 8 in that the extension segment 48 of FIG. 8 includes fold 56 between inner portion 57 and outer portion 59. Inner portion 57 is sealed to second flange 22 at point 52 while outer portion 59 descends past flanges 18, 22.

Figure 9:
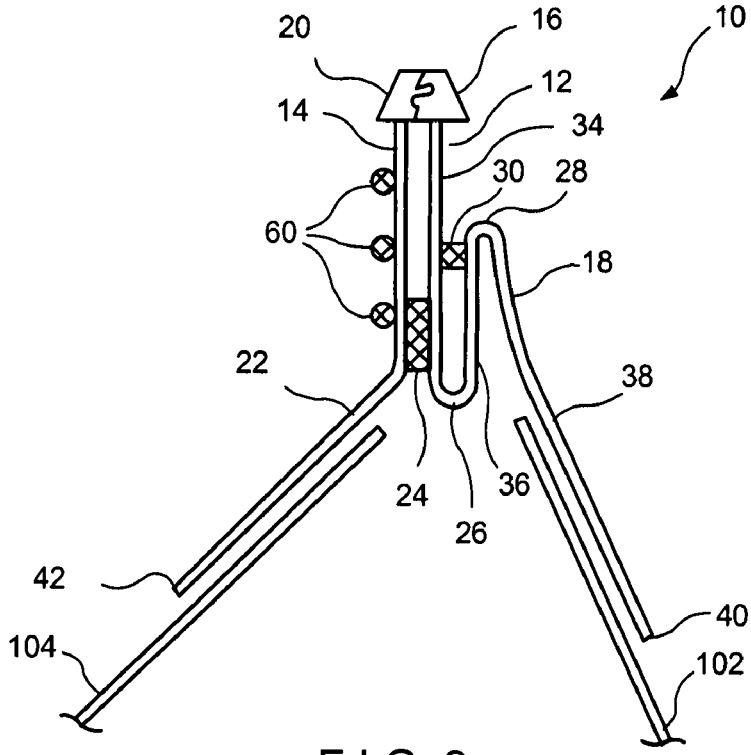
FIG. 9 is a cross-sectional view of a third alternative embodiment of the zipper showing the use of reinforcing ribs on one profile.
Figure 10:
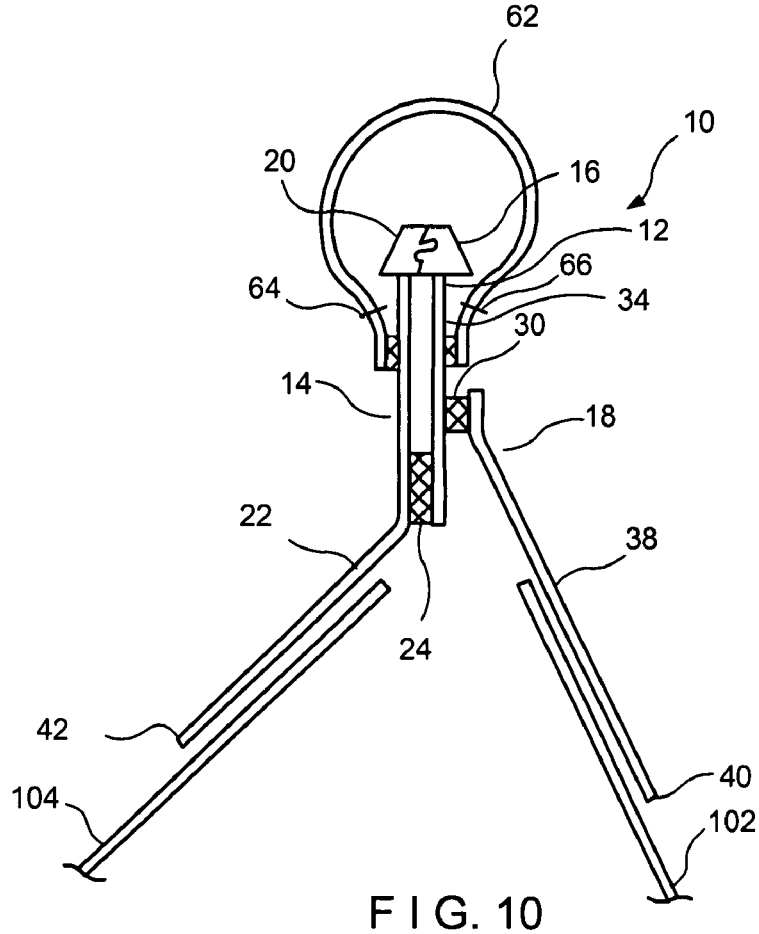
FIG. 10 is a cross-sectional view of a fourth alternative embodiment of the zipper showing a tamper-evident removable hood.

The alternative embodiment of FIG. 9 includes reinforcing ribs 60 on flange 22 to increase the stiffness of flange 22. The alternative embodiment of FIG. 10 (based on the construction of FIG. 3) includes tamper-evident header 62 formed of film enclosing zipper assembly 10. Tamper-evident header 62 includes lines of weakness 64, 66, typically formed by a perforated or scored line, in order to provide access to zipper assembly 10.

Figure 11:
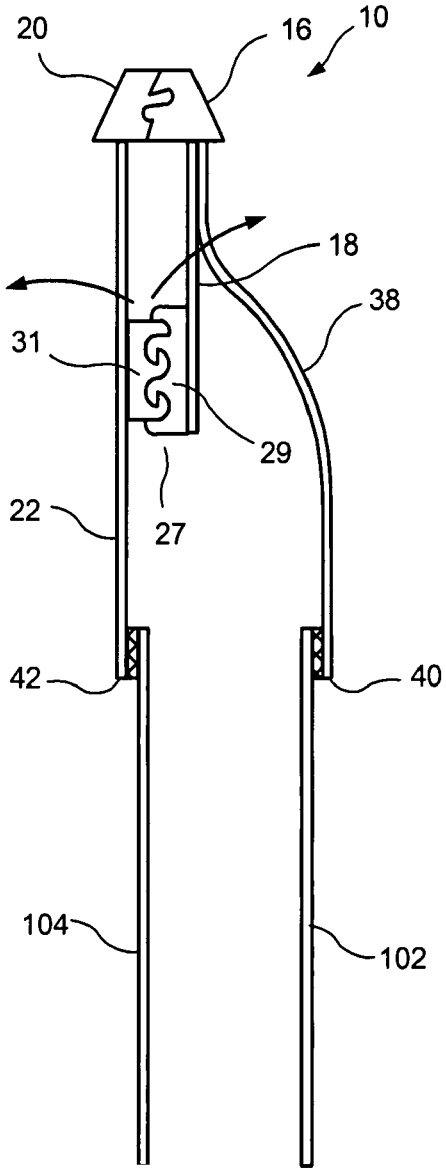
FIG. 11 is a cross-sectional view of a fifth alternative embodiment of the zipper, which substitutes a secondary zipper-type assembly for the peel seal.
Figure 12:
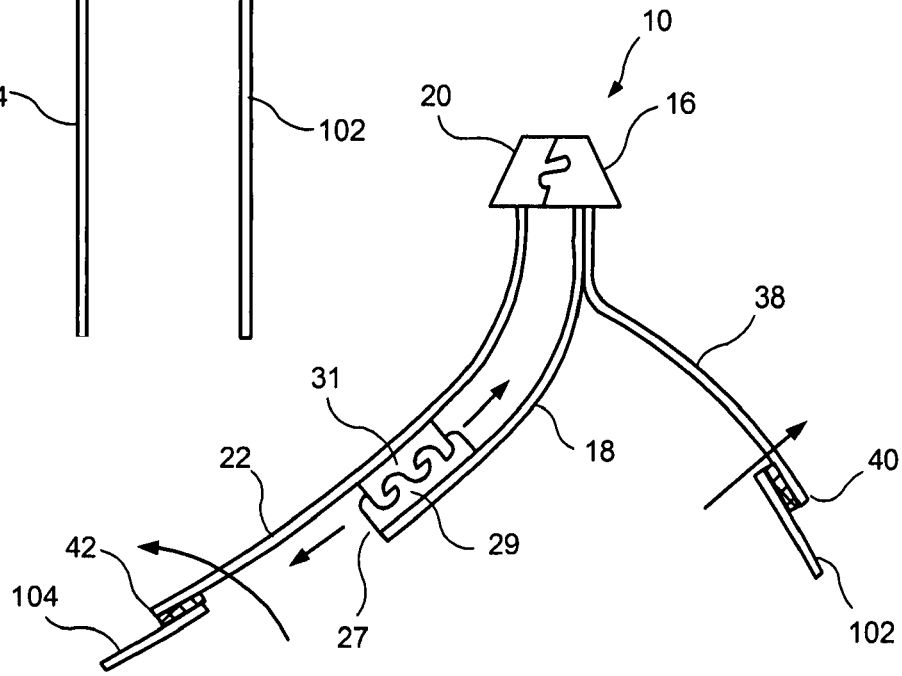
FIG. 12 is a cross-sectional view of the fifth alternative embodiment of the zipper, shown in a loaded position thereby putting the secondary zipper-type assembly into a shear configuration.

The alternative embodiment of FIG. 11 (unloaded) and FIG. 12 (loaded) substitutes the separable connection of secondary zipper 27 for the separable connection of peel seal 24 of the previous embodiments. Secondary zipper 27 includes first interlocking profile 29 attached or sealed to first flange 18 and second interlocking profile 31 attached or sealed to second flange 22. As shown in FIG. 12, the loaded configuration, or other forces from within the package 100, causes a shear force to be applied to secondary zipper 27. Secondary zipper 27, similar to peel seal 24, resists a shear force to a much greater extent than a peeling force thereby increasing the strength of the resulting package when in the loaded configuration of FIG. 12. The possibility of the substitution of the secondary zipper 27 for the peel seal 24 is envisioned for all of the disclosed embodiments of zipper assembly 10.

Figure 13:
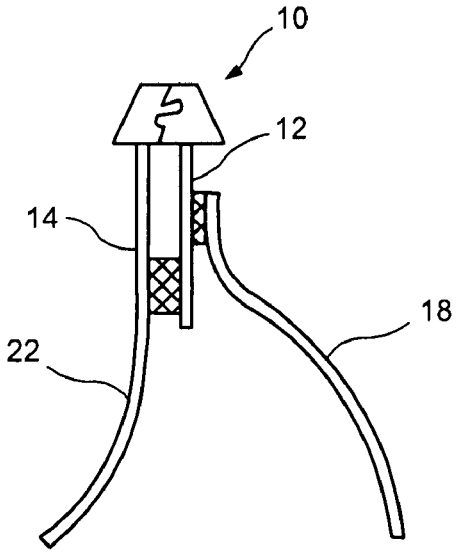
FIG. 13 is a cross-sectional view of the zipper profile, prior to attachment to the package or bag walls, and further prior to the stomping of the ends and the insertion of the sliders.
Figure 14:
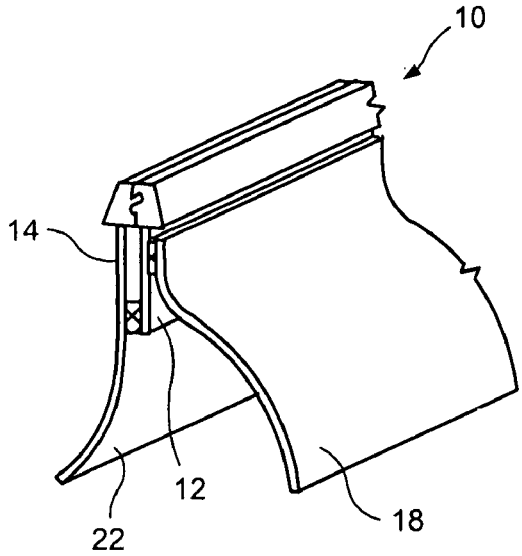
FIG. 14 is a perspective view of the zipper profile, prior to attachment to the package or bag walls, and further prior to the stomping of the ends and the insertion of the sliders.
Figure 16:
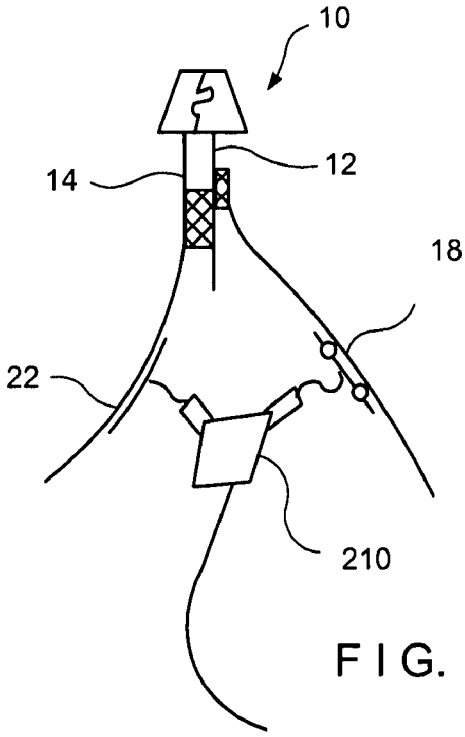
FIG. 16 is a cross-sectional view of glue or similar adhesive being inserted onto the interior of the flanges of the zipper.
Figure 15:
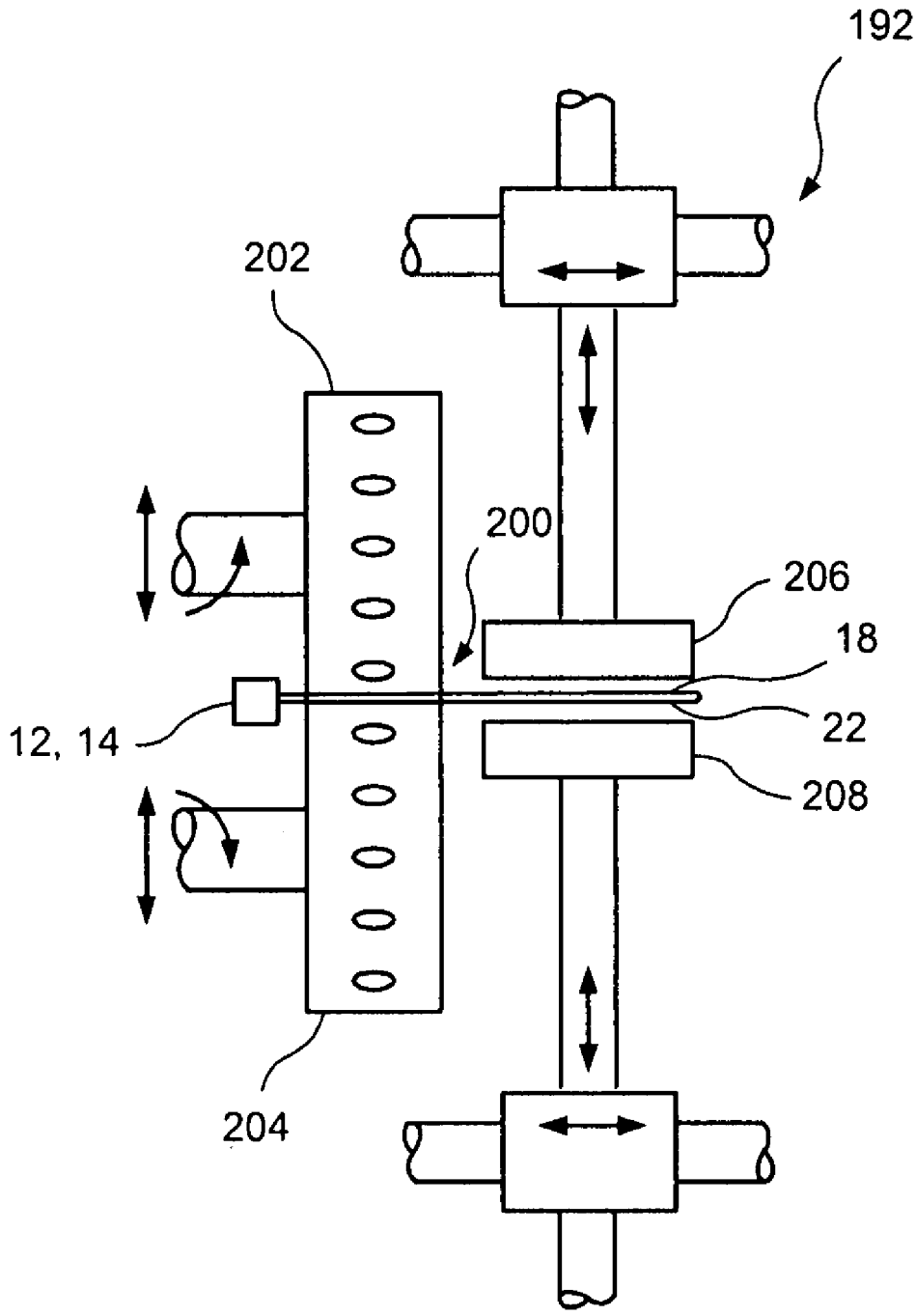
FIG. 15 is a plan view of the vacuum device used to spread the flanges of the zipper prior to the adhesive insertion step.

The manufacturing process of reclosable package or bag 100 is illustrated in FIGS. 13-18. A continuous length of interlocked zipper profiles 12, 14 is illustrated in FIGS. 13 and 14 and is typically provided from a spool 190 (see FIG. 17). The flanges 18, 22 of zipper profiles 12, 14 are then spread apart, typically by a spreader apparatus 192 such as is illustrated in FIG. 15 (also see FIG. 17) wherein the portion of flanges 18, 22 immediately below the interlocked profiles 12, 14 is fed into the nip 200 between rollers 202, 204. A portion of flanges 18, 22 extends therefrom and is engaged by vacuum elements 206, 208. Vacuum elements 206, 208 spread the portions of flanges 18, 22 extending from rollers 202, 204 so that adhesive, typically a hot-melt reactive adhesive such as a hot melt, cross-linkable adhesive (particularly, a hot melt cross-linkable polyurethane reactive adhesive), can be applied or otherwise placed by nozzle 210 onto the interior of flanges 18, 22 as shown in FIG. 16 (those skilled in the art will recognize that some adhesives should be applied by a downwardly pointing nozzle 210 with the orientation of the flanges 18, 22 during adhesive application changed in accordance therewith). Additionally, optional plasma or corona discharge station 209 may change the surface energy (described later in detail herein) of the flanges 18, 22 prior to application of adhesive. The flanges 18, 22 are temporarily clamped by clamps 194 (see FIG. 17), or pressure similarly applied, to the outside bag walls 102, 104 of successive packages or bags 100 (typically supplied with an open bottom and free of contents).

The adhesive layer is typically applied to flanges 18, 22 in a path divergent or parallel to the bag supply so that the flanges 18, 22 are subsequently guided from the divergent or parallel path to a position wherein the bag walls are captured within the flanges 18, 22.

Figure 17:
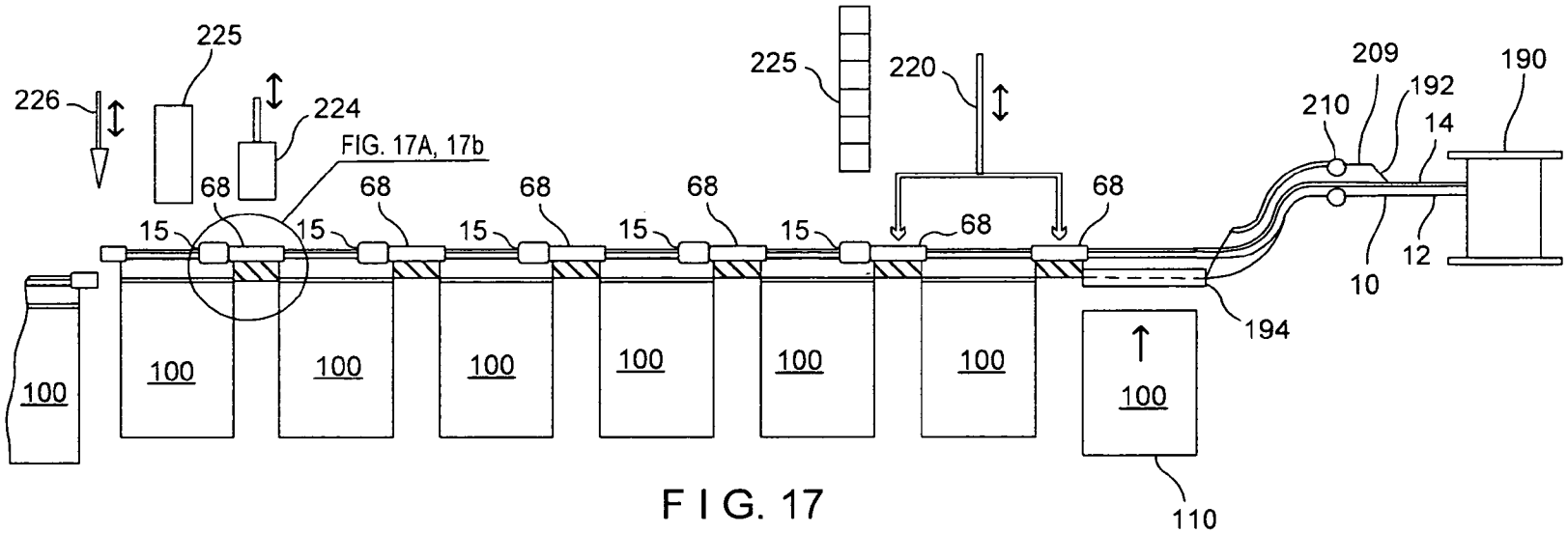
FIG. 17 is a schematic of the processing of the packages or bags after the zipper has been attached.

Zipper 10 is stomped at stomp locations 68 at package-width intervals, typically two stomps 68 at a time, by stomper 220 and slider 15 is inserted therebetween by slider inserter 222 as shown in FIG. 17. The laterally extending excess portions of the flanges are heat sealed, glued, or ultrasonically bonded to each other by bonding station 224.

Figure 17B:
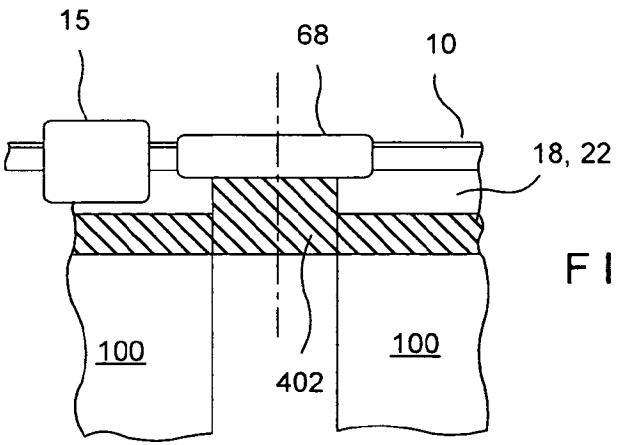
FIGS. 17A and 17B are alternative plan views of the sealing of the flange ends of FIG. 17.
Figure 17A:
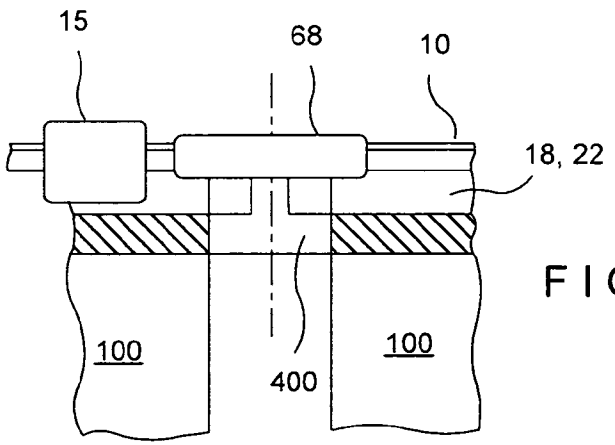

FIG. 17A illustrates a possible configuration for the flanges 18, 22 to be sealed to each other in an inverted T-shaped area 400 below end stomp 68 between successive bags 100 by bonding station 224. FIG. 17B illustrates a possible configuration for the flanges 18, 22 to be glued to each other in rectangular area 402 between edges of successive bags 100 and below end stomp 68.

Figure 18:
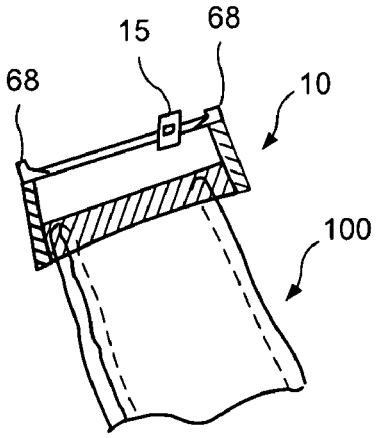
FIG. 18 is a plan view of the reclosable package or bag with the zipper attached thereto.

The zippers are then cut at cutting station 226 to achieve the package 100 illustrated in FIG. 18 (with the phantom lines illustrating a gusset between the front and rear walls). The resulting packages or bags 100 are typically unfilled and have an open bottom. Optional filling station 225 is illustrated prior to cutting station 226. Optional filling station 225 may be top filling (in which case, zippers such as illustrated in FIG. 22 or 24-26 may be used) or bottom filling (in which case, the packages or bags are inverted and a bottom sealer is included with the filling station 225). However, separate subsequent filling steps may be performed at a different location to fill packages or bags 100 with contents and seal the bottom 110 of the package or bag 100.

Alternative embodiments may cut the zippers prior to the application of the adhesive, may include pre-mounted sliders, or sliders inserted and stomps formed prior to the gluing process. Walls 102, 104 may be folded to form gussets prior to the securing of the zipper assembly 10 thereto. Similarly, gussets may be attached below or within the flanges 18, 22 by glue dots or similar connection methods. To reinforce the gussets underneath the zipper assembly 10, glue may be applied in between the inside faces of the gussets or in between the outside faces of the gussets.

Figure 19:
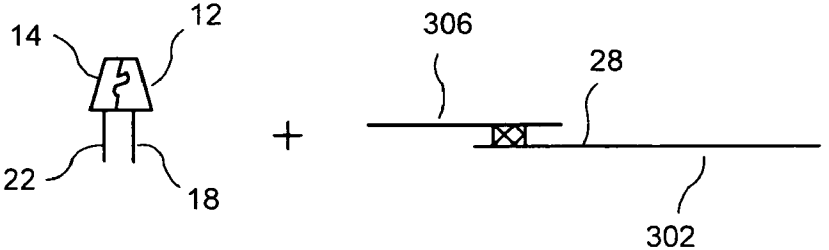
FIG. 19 illustrates a first alternative for manufacturing the zipper.
Figure 20:
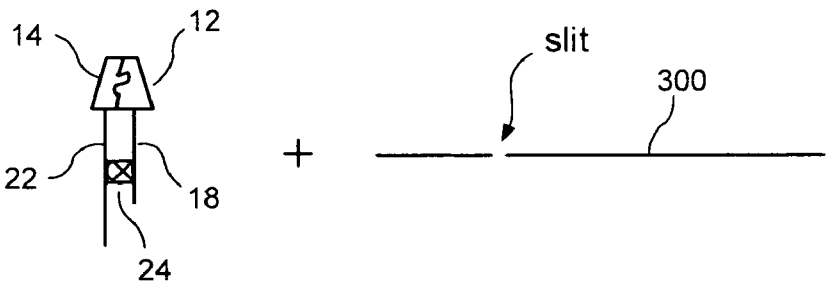
FIG. 20 illustrates a second alternative for manufacturing the zipper.
Figure 21:
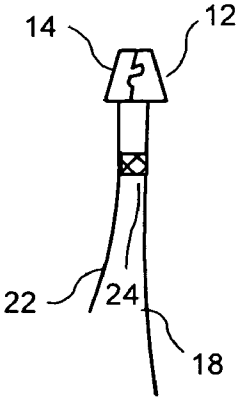
FIG. 21 illustrates a third alternative for manufacturing the zipper.

FIGS. 19, 20 and 21 illustrate variations in the formation of the zipper assembly 10. FIG. 19 illustrates how first and second sheets of web 300, 302 can be joined by peel seal 24, a fold 28 formed in second sheet of web 302 and then sealed to first and second flanges 18, 22 thereby achieving a construction similar to FIG. 2. Similarly, FIG. 20 illustrates first and second profiles 12, 14 being joined by peel seal 24 and first sheet of web 300 being slit into two pieces which are sealed to flanges 18, 22 thereby forming a construction similar to that illustrated in FIG. 3. In FIG. 21, a lower portion of first flange 18 is removed and then resealed to an upper portion of first flange 18 thereby likewise forming a construction similar to that illustrated in FIG. 3. Alternatively, first flange 18 can be folded to achieve the construction of FIG. 2. Further alternatively, the T-shaped configuration of first flange 18 can be achieved by simultaneous extrusion of a single T-shaped flange.

With respect to the adhesive used by nozzle 210 to fasten the zipper assembly 10 to the walls 102, 104 of package 100, it has been found that hot melt, cross-linkable adhesives (such as hot melt polyurethane reactive adhesive which are cross-linkable) have been found to be superior to ordinary hot melt adhesives, both for multi-wall paper and woven polypropylene walls. Likewise, this adhesive has been found superior for the construction of all seams of package or bag 100, including bottom seam 110 and longitudinal seam 111. This was determined by tests in which the package 100 was loaded with 2.5 times its rated load and hung upside down (that is, with the load bearing on the zipper assembly 10) and placed in 140 degree Fahrenheit environment (which is representative of temperatures which may be encountered during shipping) for seventy-two hours. The package 100 was considered to have passed this test if the package 100 maintained its integrity during this period.

Likewise, this test can be performed for the same load (2.5 times rated load) and period (seventy-two hours) at negative 20 degrees Fahrenheit (−20° F.) for simulation of cold environments which may be encountered during transportation and storage in some climates. The hot melt, cross-linkable adhesives (such as hot melt polyurethane reactive adhesive which are cross-linkable) have likewise been found to be superior under these tests and can be applied to all seams of packages, with or without a reclosable zipper.

Similarly, it has been found that pre-treatment of the olefin structures of the walls 102, 104 (particularly if made from woven polypropylene) and zipper flanges, typically by corona discharge or plasma treatment of the walls and flanges, improves the adhesion bond of the hot melt, cross-linkable adhesive (such as hot melt cross-linkable polyurethane reactive adhesive) between the walls and zipper flanges, particularly for film structures having a non-polar surface energy of less than 40 dynes per square centimeter.

Additionally, heat sealing may be effective in instances wherein the bag surface includes resin binder type inks.

Figure 22:
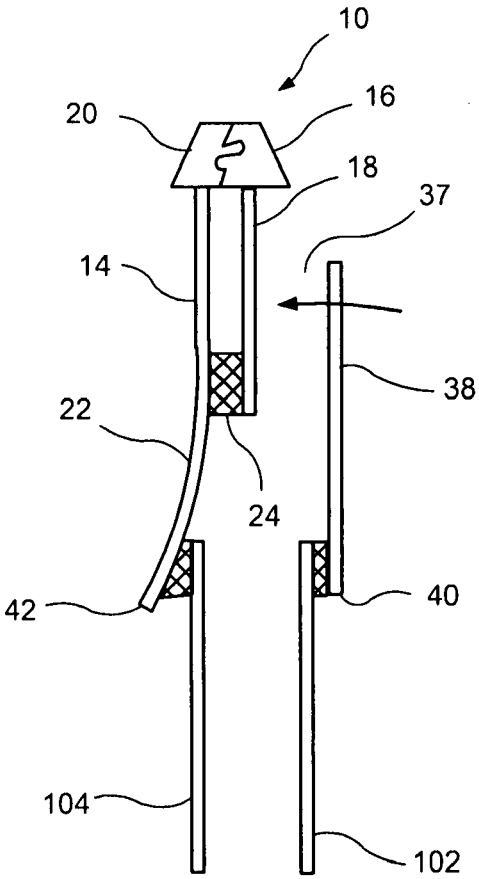
FIG. 22 is a cross-sectional view of a first alternative top-filling embodiment of the zipper.

As shown in FIG. 22, in the first alternative top-filling embodiment of zipper assembly 10, distal ends 40, 42 of respective segment 38 and second flange 22 are attached to respective front and rear walls 102, 104 prior to the attachment or sealing of segment 38 to first flange 18. Segment 38 is typically a polyethylene strip that is attached by glue to the bag wall prior to the filling of the package or bag and by a heat seal to flange 18 after the package or bag is filled. This allows the package to be filled with contents through the gap or opening 37 between segment 38 and first flange 18 prior to the joining or sealing of segment 38 to first flange 18. This top filling eliminates the bottom filling typically associated with many of the other disclosed embodiments.

Figure 23:
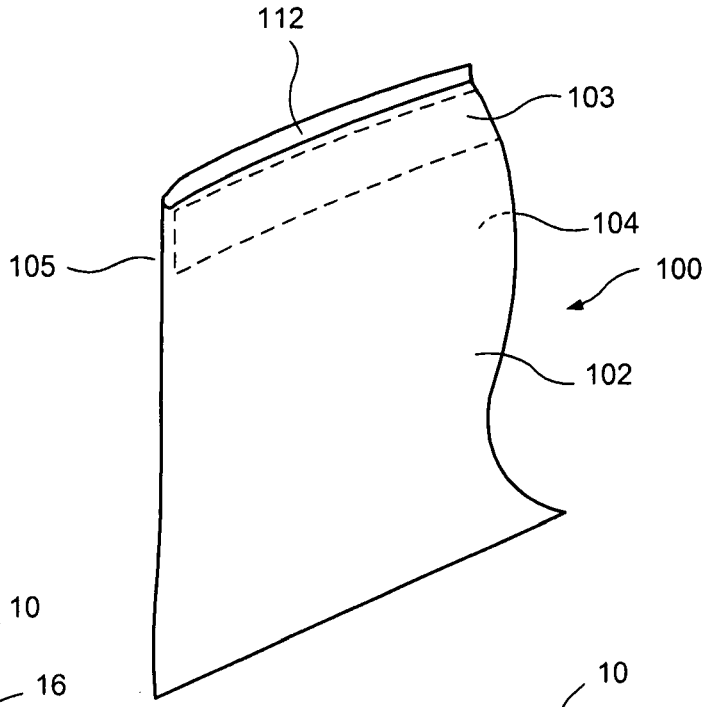
FIG. 23 is a perspective view of the walls of the package, with strips of polyethylene, in preparation for the second alternative top-filling embodiment of the zipper, as shown in FIG. 24.

As shown in FIG. 23, in the second alternative top-filling embodiment of zipper assembly 10, polyethylene strips 103, 105 are attached to the exterior of front and rear walls 102, 104 immediately adjacent to mouth 112. Extension segment 46 is typically heat sealed or otherwise attached to polyethylene strip 103 prior to filling of the package 100 and extension segment 48 is typically heat sealed or otherwise attached to polyethylene strip 105 after filling of the package 100 to reach the configuration shown in FIG. 24. While FIG. 24, as well as FIG. 25, is illustrated with the zipper assembly 10 of FIG. 7, other equivalent zipper configurations could be substituted for this zipper assembly 10, as would be recognized by those skilled in the art after review of this disclosure.

Figure 24:
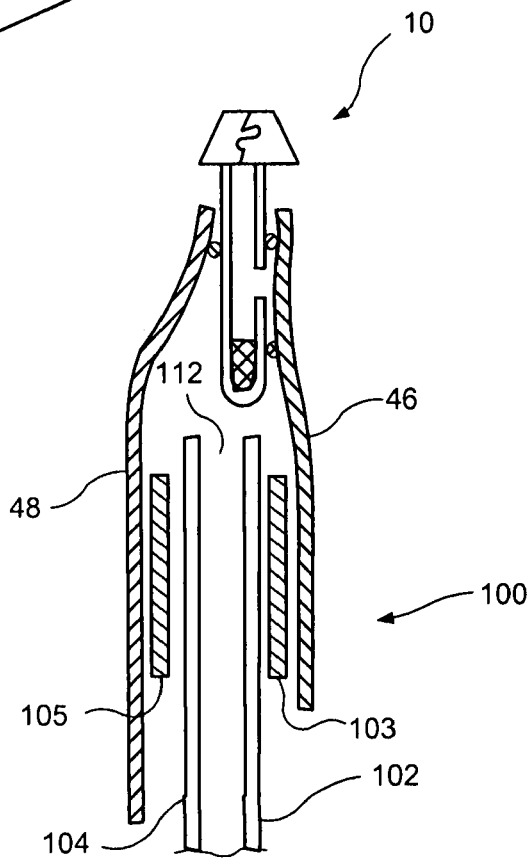
FIG. 24 is a cross-sectional view showing the second alternative top-filling embodiment of the zipper attached to the package walls.
Figure 25:
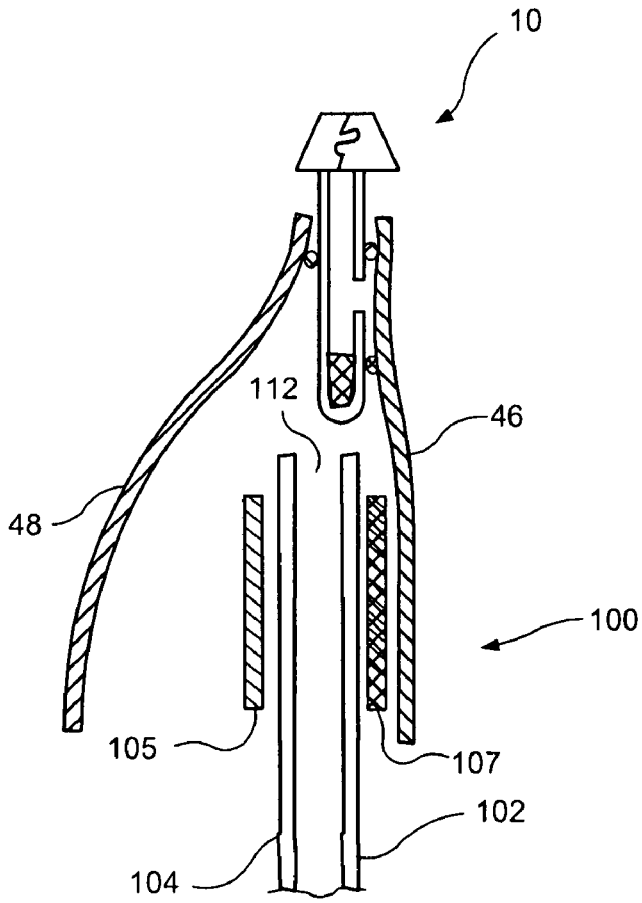
FIG. 25 is a cross-sectional view showing the third alternative top-filling embodiment of the zipper attached to the package walls.

FIG. 25 shows a third alternative top-filling embodiment of zipper assembly 10, similar to that shown in FIG. 24, except that extension segment 46 is glued to front wall 102, typically by hot melt, cross-linkable adhesive (such as hot melt cross-linkable polyurethane reactive adhesive) 107 prior to filling of the package 100, thereby obviating the need for polyethylene strip 103. After filling of package 100 with contents, similar to the embodiment shown in FIG. 23, extension segment 48 is heat sealed to polyethylene strip 105 on rear wall 104.

Figure 26:
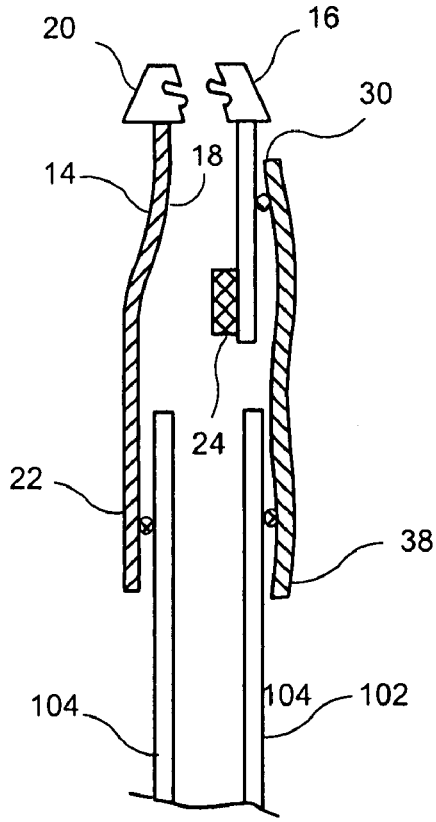
FIG. 26 is a cross-sectional view showing the fourth alternative top-filling embodiment of the zipper attached to the package walls.

FIG. 26 illustrates a zipper assembly 10, similar to that of FIG. 3, wherein flange 22 and segment 38 are glued or otherwise sealed or attached to front and rear walls 102, 104 prior to the formation of peel seal 24. Peel seal 24 is formed and activated thereby joining first and second flanges 18, 22 to each other after the filling of package 100 with contents between first and second interlocking elements 16, 20 as shown by arrow labeled as "fill". This filling may be done by using the slider (see FIG. 1) to separate the first and second interlocking elements 16, 20, filling between first and second interlocking elements, and then using the slider to interlock first and second interlocking elements 16, 20.

Those skilled in the art will recognize a broad range of possible contents for the packages 100, including, but certainly not limited to, charcoal, pet food, livestock or other animal food, cat litter, fertilizer, seeds, plant bulbs, rock salt, and foodstuffs.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A zipper assembly for a reclosable package, including:

a first profile with a first flange and a first interlocking element;

a second profile with a second flange and a second interlocking element;

the first flange including a first portion extending from the first interlocking element, a second portion, a third portion, a first fold formed between the first and second portions, and a second fold formed between the second and third portions;

a separable connection formed between the first portion and a central area of the second flange, wherein the separable connection is more resistant to a shear force than to a peeling force; and a seal formed between the second portion and an area of the first portion between the frangible connection and the first interlocking element.

2. The zipper assembly of claim 1 wherein a load on the first and second flanges applies a shear force to the separable connection.

3. The zipper assembly of claim 2 wherein the separable connection is a peel seal.

4. The zipper assembly of claim 3 further including a slider mounted on the first and second profiles, whereby movement of the slider in an opening direction separates the first and second interlocking elements from each other and movement of the slider in a closing direction interlocks the first and second interlocking elements together.

5. The zipper assembly of claim 2 wherein the seal is a hard seal formed proximate to the second fold.

6. The zipper of claim 5 wherein the first fold is formed proximate to the peel seal.

7. The zipper of claim 6 wherein the peel seal is in a position intermediate the first fold and the interlocking profiles.

8. The zipper assembly of claim 1 wherein a load on the first and second flanges is redirected away from the separable connection to a location above the separable connection.

9. The zipper assembly of claim 1 wherein at least one of the first and second profiles includes reinforcing ribs.

* * * * *